US005944451A

United States Patent [19]

Martin et al.

[11] Patent Number: 5,944,451

[45] Date of Patent: Aug. 31, 1999

[54] DOCK COMPENSATOR

[75] Inventors: Steven Wyatt Martin, Sunnyvale; Leonard Vernon Martin, San Jose, both of Calif.

[73] Assignee: Snap-Back Enterprises, Inc., Santa Clara, Calif.

[21] Appl. No.: 09/049,291

[22] Filed: Mar. 26, 1998

[51] Int. Cl.[6] ..... B63C 1/00; B63B 35/44

[52] U.S. Cl. ..... 405/218; 405/195.1; 405/219; 114/258; 114/230.1; 175/7; 242/379

[58] Field of Search ..... 405/218, 220, 405/219, 221, 195.1; 166/352, 354, 356, 359; 175/7; 114/230, 258, 263, 266, 293; 254/364, 392, 900; 242/371, 372, 378.4, 379

[56] References Cited

U.S. PATENT DOCUMENTS

| | | | |
|---|---|---|---|
| 1,424,999 | 8/1922 | Frost | 242/379 |
| 1,587,426 | 6/1926 | Schwier | 242/379 |
| 2,269,534 | 1/1942 | Jaeger | 242/381.1 |
| 2,809,436 | 10/1957 | Worthington et al. | 166/352 X |
| 2,915,259 | 12/1959 | Force | 242/379 |
| 3,226,977 | 1/1966 | Kolb | 175/7 X |
| 3,255,627 | 6/1966 | Doig et al. | 175/7 X |
| 3,422,783 | 1/1969 | Moulin | 114/230 |
| 3,865,066 | 2/1975 | White et al. | 114/230 |
| 3,952,684 | 4/1976 | Ferguson et al. | 114/230 |
| 4,127,298 | 11/1978 | Egholm | 294/111 |
| 4,148,445 | 4/1979 | Reynolds et al. | 242/86.5 R |
| 4,760,992 | 8/1988 | Peppel et al. | 254/392 X |
| 5,101,905 | 4/1992 | Arlt et al. | 175/7 X |
| 5,107,784 | 4/1992 | Lacy | 114/263 |
| 5,699,975 | 12/1997 | Paugh et al. | 242/371 |

*Primary Examiner*—David J. Bagnell
*Assistant Examiner*—Jong-Suk Lee
*Attorney, Agent, or Firm*—Wagner Murabito & Hao

[57] ABSTRACT

A constant force dock compensator that provides an mooring system for floating docks. The dock compensator is comprised of constant force power springs, a reel around which sufficient lengths of cable are wound, and a case containing the springs, cables and reel. The dock compensator is attached underneath a floating dock. The cables are withdrawn from the dock compensator and attached to weights placed on the floor of the body of water. The springs maintain a constant pull-force on the cables to hold the dock in place, and the cables automatically dispense or retract to compensate for changes in water level. Thereby, the dock has some leeway in terms of movement in response thereto, but is eventually stabilized by the dock compensator.

8 Claims, 11 Drawing Sheets

DOCK COMPENSATOR

FIELD OF THE INVENTION

The present invention relates to the field of recreational and commercial boating. Specifically, the present invention relates to the field of a mooring mechanism for floating docks.

BACKGROUND OF THE INVENTION

A floating dock is a very common method to secure a boat and gain access to it. People can readily embark and disembark the boat or ship tied alongside the dock. In the prior art, a floating dock is typically connected to either pilings, cables with manual adjusting winch or cables with counter weights to secure it in place. Otherwise, the dock would drift away.

A piling is a pole similar to a telephone pole, or it may be made of steel or concrete. Pilings are driven vertically into the floor of a body of water. The pilings are of sufficient length to extend above the surface of the water. The dock floats on the water, and is connected to the pilings by retaining rings that reside in the floating dock or is fixed to lengths of cables or chains that are of sufficient length to permit the dock to rise and fall with changes in water level due to, for example, high and low tides. The fixed cable or chain type can be adjusted by either a manually adjusted winch or with the use of counter weights.

If cables or chains are used instead of pilings, the sea anchors are placed on the floor of the body of water. The dock floats on the water, and in the prior art is connected to the sea anchors by fixed lengths of cables or chains as described above.

The prior art method of mooring a floating dock in place engenders several disadvantages. The connecting cables or chains are of a fixed length, and must be long enough to accommodate the maximum anticipated change in water level and/or require regular manual adjustment to remove the cable slack.

When the water is not at its maximum level, there is a significant amount of slack in the cables or chains. This allows even relatively minor perturbations, such as the wake of a passing boat, to cause the dock to move significantly up and down and also side to side, making the dock unstable. There is also no dampening of the dock's motion beyond the natural dampening of the water itself, so the dock will move for a long period of time, and will continue to move until the water stops moving. It is difficult to stand or move about on a dock that is simultaneously moving in various directions, and objects and supplies placed on the dock are also caused to move around unexpectedly.

Furthermore, the slack in the cables or chains allows the dock to drift horizontally from its original position, due to forces acting on the dock from wind, waves, and changing tide. A drifting dock poses a concern to adjacent docks and boats. Also, the dock will drift to the point where at least one of the cables or chains is taut, placing a significant stress load on the fittings to which the cable or chain is attached, or on the fittings and hinges connecting the dock to the dock ramp. This could lead to failure of a fitting, creating a need for immediate repair.

In addition, depending on the placement of the pilings or weights, the cables or chains connected to them from the dock may extend into areas where they create a hazard for individuals and/or boats. For example, a cable running underneath the water beyond the edge of the dock could be hit by someone diving or swimming, or could be hooked by the outboard drive gear of a passing boat.

The use of pilings introduces additional disadvantages that are not present if weights are used. The pilings disturb the floor of the body of water when they are driven through and into it. If telephone poles are used, the creosote, oil or tar present in the pole will leach into the water. Concrete will also leach into the water. The leaching contributes to water pollution, and also may cause deterioration of the pilings to the point where eventually they require replacement. Pilings are expensive, and therefore the initial cost of a dock that utilizes them is high. Should replacement of the pilings be required, the lifetime cost of the dock is even more substantial. Finally, the pilings protruding from the water may be unsightly, especially if they are not periodically cleaned. Furthermore, pilings greatly loose their effectiveness in water depths beyond 25' because of excessive bending or flexing.

Thus, there is a need for an apparatus that avoids the problems described above while addressing the concerns associated with prior art methods for mooring a floating dock. It would be highly preferable if such an apparatus allows vertical movement of the dock corresponding to changes in water level. Such an apparatus should also prevent the dock from drifting from its original position, and would compensate for lateral forces on the dock due to wind, waves, and currents. It would also be highly preferable if the apparatus actively dampens dock motion so as to maintain a stable surface and quickly return the dock to its initial ("neutral") position. In addition, it would be highly preferable because the apparatus eliminates the need for pilings.

Accordingly, it is the object of the present invention to allow sufficient vertical movement of a floating dock to account for changes in water level, either shorter term changes such as waves or longer term changes such as tide. In addition, it is the object of the present invention to maintain the dock in its original horizontal position, by applying sufficient pulling force on the connecting cables so that there is no slack in the cables, and by compensating for lateral forces on the dock. It is also the object of the present invention to quickly dampen dock motion to maintain a stable surface and return the dock to its neutral position.

Furthermore, it is the object of the present invention to provide a cost-effective and environmentally sound design that eliminates the need for pilings. Finally, it is the object of the present invention to be safe, compact and durable, and compatible with current floating docks.

SUMMARY OF THE INVENTION

The present invention pertains to a Dock Compensator which is designed to provide a mooring system for floating docks, using cables connected to sea anchors in the water. The present invention allows a floating dock to move vertically with changes in water level, but dampens the movement to maintain a stable surface and return the dock to its original position. The present invention also prevents the dock from drifting from its original position, by compensating for lateral forces on the dock and by dispensing only the required length of cable so that there is no slack in the cable that would allow the dock to drift. In addition, the present invention does not require the use of pilings.

In its preferred embodiment, the present invention is comprised of constant force power springs, an arbor (shaft), a reel assembly, two stainless steel cables, and an outer case. The number of springs utilized by the present invention can be varied depending on the amount of pull-force desired;

therefore, the concept of the present invention allows sufficient design flexibility such that the present invention can be utilized for large marina and/or small private dock installations. In the currently preferred embodiment of the present invention FIGS. 4A and 4B, three and ten springs are used respectively.

The springs are mounted parallel to each other with their center points in alignment, with spacers in between the springs to reduce friction and to prevent them from interfering with each other. The end at the center of each spring is attached to the same single arbor, which is secured at each end to the outer case. The other end of each spring is attached to the same single reel assembly, which rotates with the arbor as its center axis. Two steel cables of sufficient length are wound around the same single reel.

The springs are either stainless steel or treated carbon steel and are designed to exert a constant torque, or pulling force, on the reel. The constant torque capability of the springs is necessary for the present invention to accomplish its design objectives over the entire range of the springs and, concurrently, over the entire length of the cables. The amount of torque provided by the springs is by design small enough to allow the cables to extend as needed in response to waves or the changing tide, so that the dock is permitted to continue to float on the surface of the water. However, the amount of torque provided by the springs is by design large enough to dampen the motion of the dock caused by waves, so that the dock is quickly returned to its initial stable position. The amount of torque is also large enough to limit the amount of cable that is dispensed from the present invention, so that there is no slack in the cable.

The two cables are wound side-by-side but are separated by a ring, or guide, that prevents the cables from tangling with each other. The reel is designed to hold the sufficient length of the cables, and to dispense and rewind the cables within the number of revolutions permitted by the range of application of the springs. Each cable passes through its own opening in the outer case. The openings are flared and equipped with rollers to reduce friction, so that the cables can be more easily dispensed and retracted. The outer case contains the springs, the arbor, the reel, and the cables.

Additional features of the currently preferred embodiment of the present invention are implemented to make it durable and resistant to corrosion, easy to install and use, and compatible with current floating docks. The present invention is used as follows. The present invention is mounted either on the underside or on top of the dock, at the dock's center point. Two cement blocks or similar weights are placed on the floor of the body of water, one at each end of the dock. The steel cables are unwound from the reel, and one cable is attached to one weight, and the other cable is attached to the second weight. Because the cables are both around the same reel, the length of each cable that is dispensed will be equal. Unwinding the cables from the present invention compresses the springs.

After the cables are attached to the weights, the constant pull force of the springs retracts the cables and removes any slack. As above, because the cables are wound around the same reel, each cable is also retracted by the same amount. With each cable at an equal length, the dock will remain in position until it is disturbed by a change in water level. When the water level changes, an equal length of each cable is dispensed or retracted depending on whether the water level increases or decreases. The present invention is designed to achieve equilibrium on the cables. If the dock is pushed laterally, 100% of the force of the power springs will transfer to the cable which is under load. For example, when the tide is rising, the cables extend (each by the same amount), and there is no slack in the cables because the power springs maintain a constant pull-force on them. For a shorter perturbation, such as a wake from a passing boat, the dock rises with the wave and the cables extend. The constant pull-force of the power springs serves to dampen the dock motion and quickly return the dock to its neutral and stable position. In a similar manner, the present invention compensates for lateral motion of the dock due to wind, waves and current.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE INVENTION

In the following detailed description of the present invention, numerous specific details are set forth in order to provide a thorough understanding of the present invention. However, it will be obvious to one skilled in the art that the present invention may be practiced without these specific details. In other instances, well known methods, procedures, components, and materials have not been described in detail so as not to unnecessarily obscure aspects of the present invention.

Figure 1A:
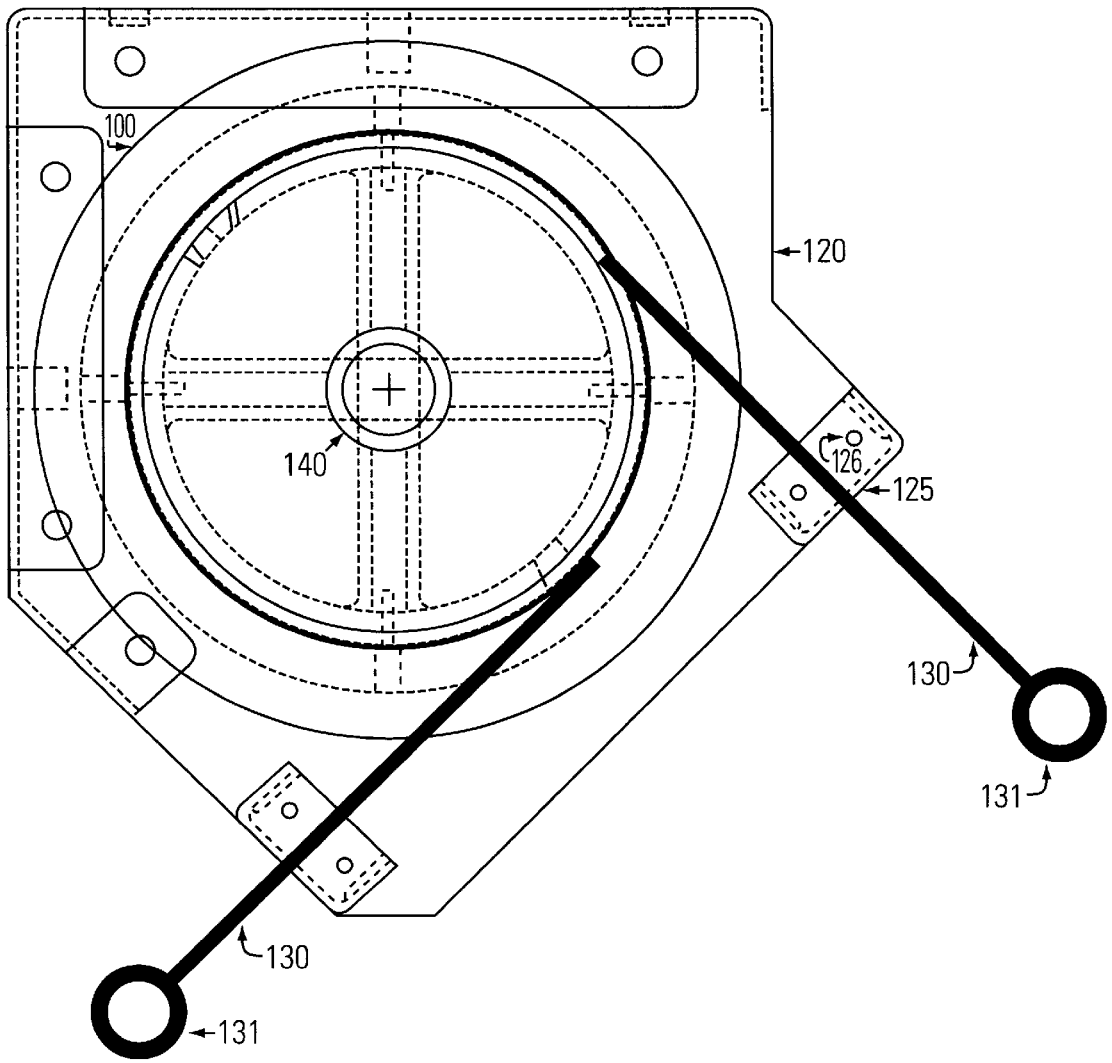
FIG. 1A is a side-view of the cross-section of the reel assembly, arbor, cables, wire thimbles, and outer case of the present invention.
Figure 1B:
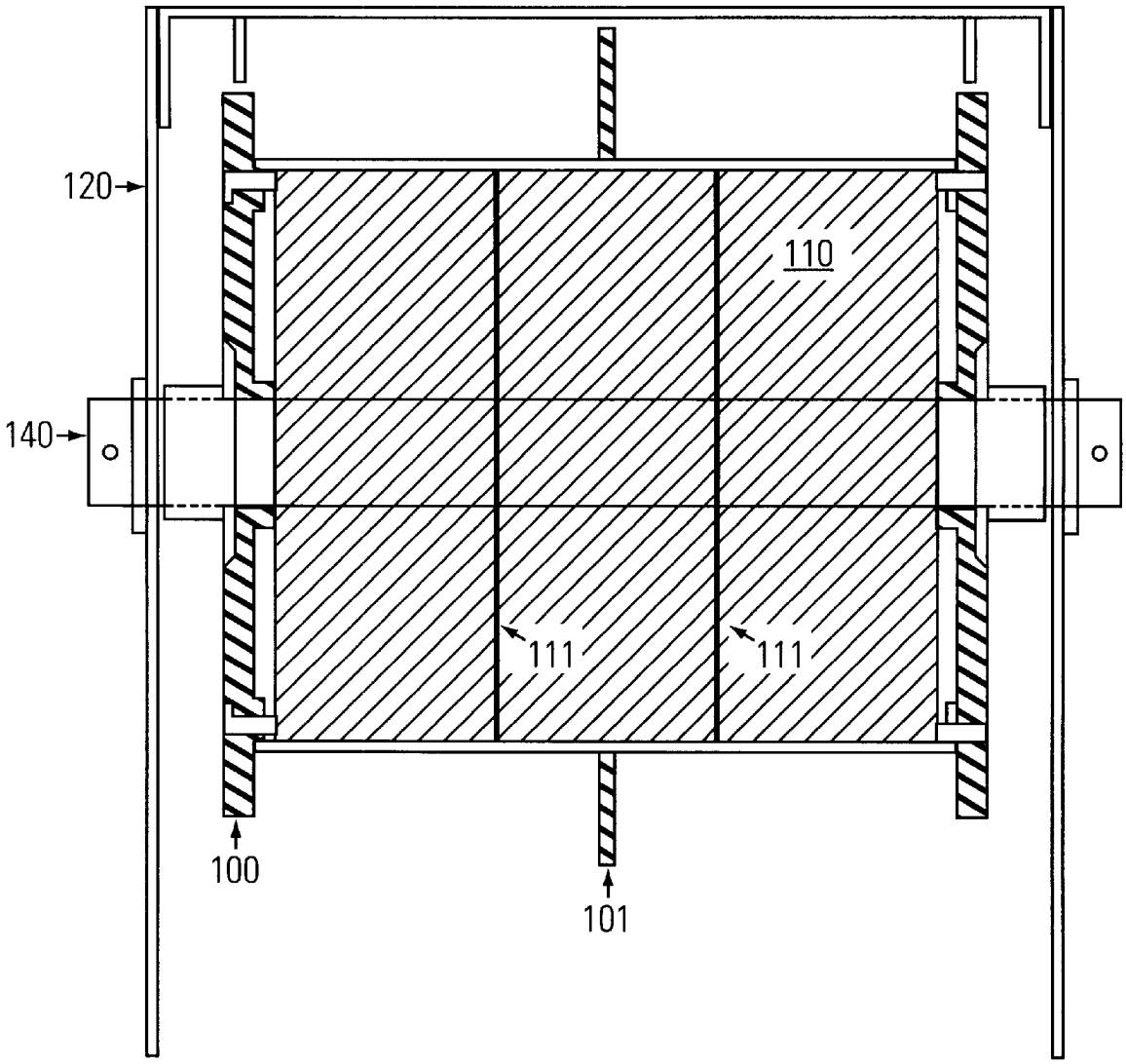
FIG. 1B is a front-view of the reel assembly including springs, spring separators, arbor, reel, cable guide, and outer case of the present invention.
Figure 1C:
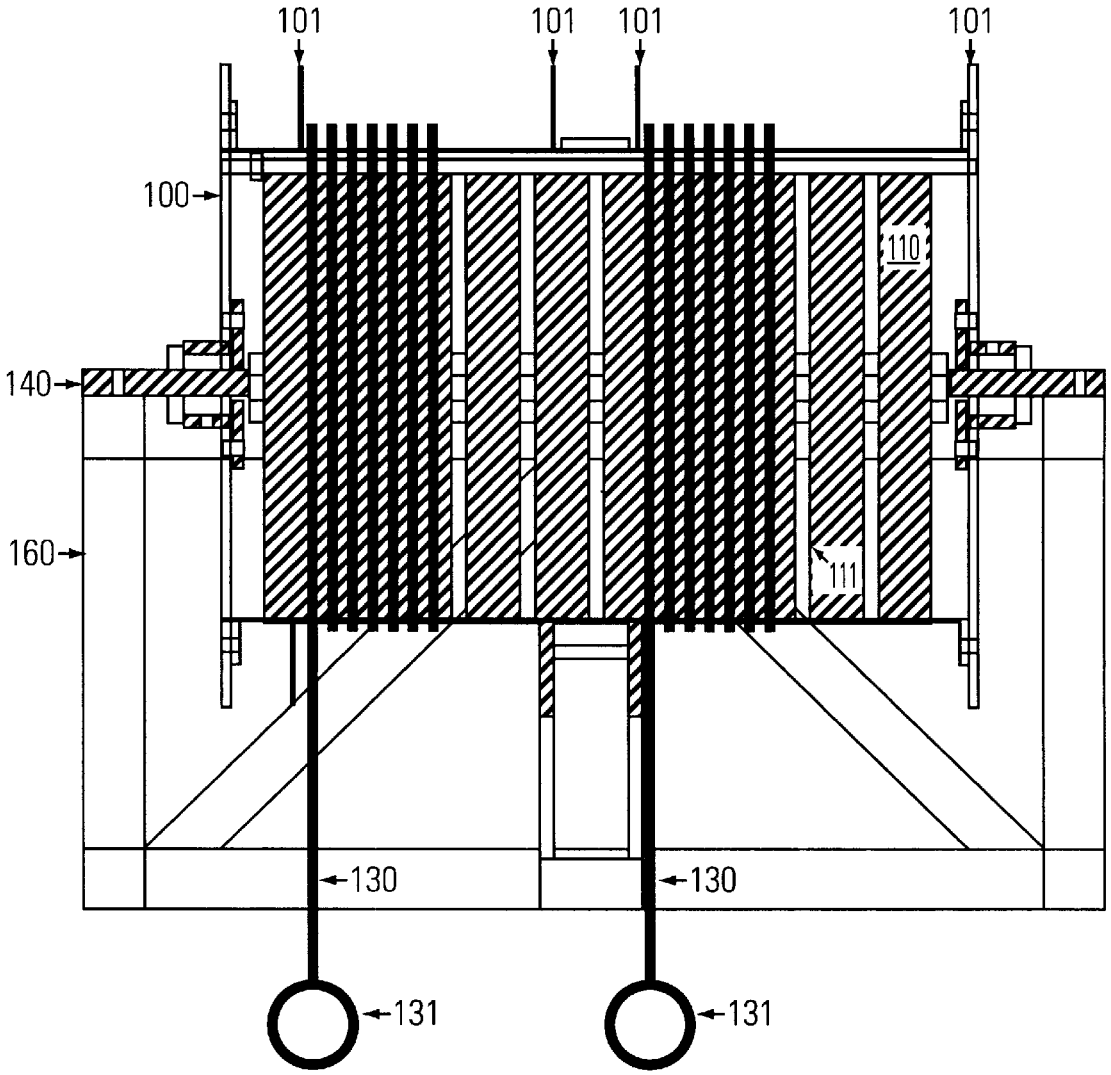
FIG. 1C is a front-view of the reel assembly including springs, spring separators, arbor, cable, frame and band brake of the present invention.
Figure 1D:
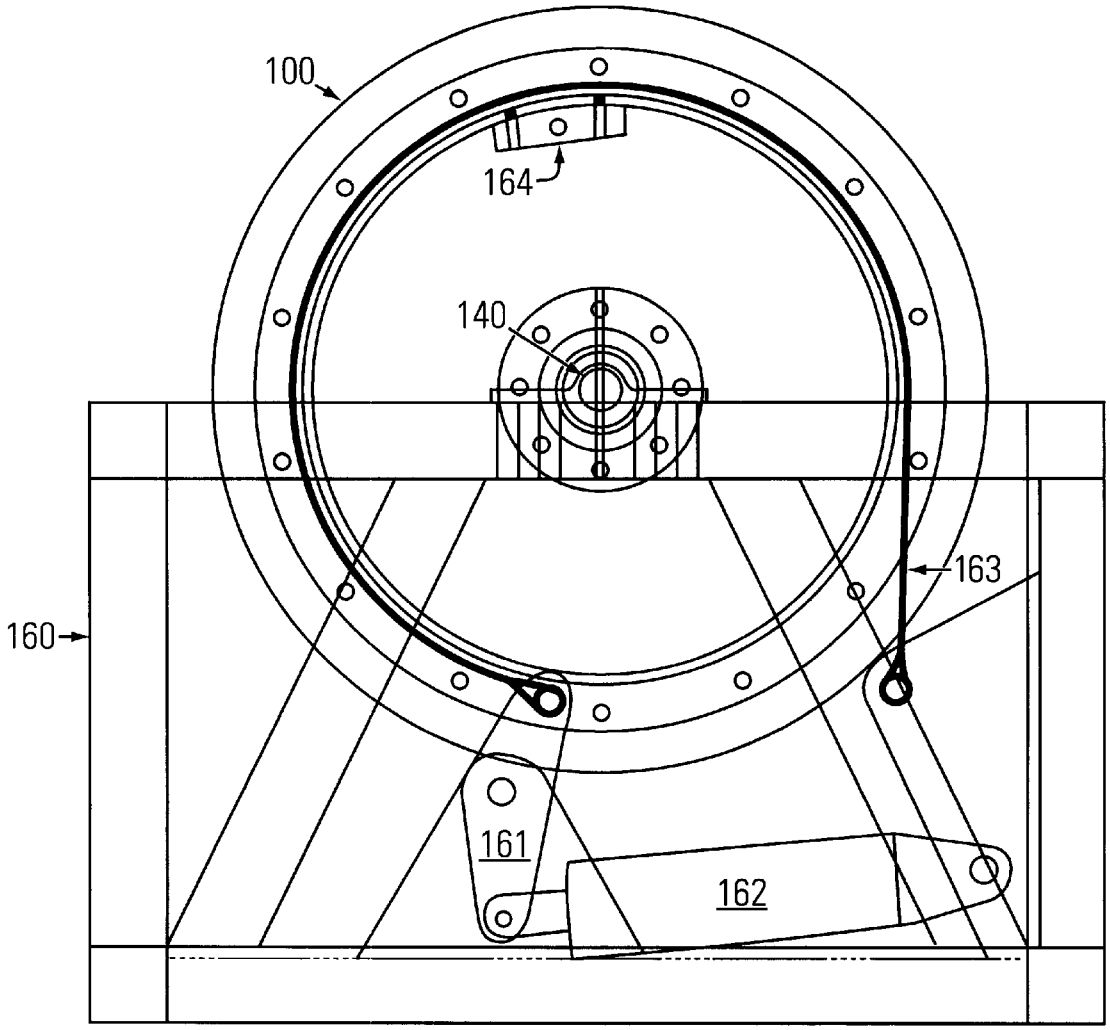
FIG. 1D is a side-view of the reel assembly including springs, spring separators, arbor, cable, frame, brake actuator and band brake of the present invention.

With reference to FIGS. 1A, 1B, 1C and 1D, the present invention reel assembly 100, power springs 110, outer case 120, frame 160, cable(s) 130, brake lever 161, brake actuator 162, brake band 163 and arbor 140 are illustrated. FIGS. 1A and 1D are a cut-away side view, and FIGS. 1B and 1C are a cut-away front view. The present invention is a device consisting of constant force stainless or carbon steel power springs 110 mounted within a reel assembly 100, which in turn is within an outer case 120 or frame 160. With reference to FIGS. 1B and 1D, in the currently preferred embodiment three and ten springs are used respectively; however, the number of springs is variable in alternative embodiments depending on the size of the application.

Separation between the springs is maintained by spacers 111. One end of each spring is attached to the single common arbor 140, and the other end of each spring is attached to the single common reel assembly 100. The springs 110 are attached to a single arbor and reel assembly to increase the total pull-force of the springs by taking advantage of the synergistic effect associated with such a mounting. In addition, such a mounting eliminates any undesirable effects associated with variability in spring performance; therefore, it is not necessary to ensure that each spring performs identically or to compensate for differences in performance.

With reference still to FIGS. 1A, 1B, 1C and 1D, the reel assembly 100 holds two separate 3/16"–1" steel cables 130. The cables 130 are located within one single reel assembly, so that when the reel assembly rotates by a particular amount, an equal length of each cable is dispensed or retracted. This is an important feature of the present invention, because it ensures that the dock will stay in one position, and return to that position if the dock is moved. Separation between the two cables is maintained by a guide 101. The cables 130 are of sufficient length to compensate for water level changes of up to thirty feet.

At the end of each cable 130 is a wire thimble 131 used to attach the cables to concrete weights placed on the floor of the water body. The present invention transfers the torque from the springs 110 through the reel assembly 100 and cables 130. The present invention is attached to the underside or on top of the floating dock, and the cables 130 are extended and attached to concrete weights located at each end of the dock (refer to FIG. 5). The pull-force of the springs 110 will maintain the dock in a stable position and will compensate for long term changes in water level (e.g., due to tide), and return the dock to its initial and stable position after a short term change in water level (e.g., a wave or the wake of a passing boat).

Figure 2A:
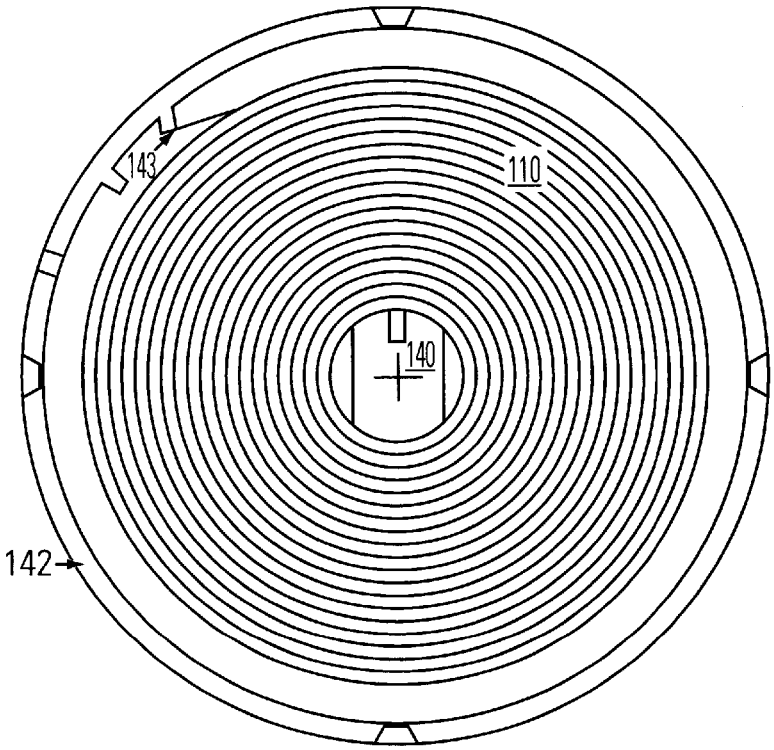
FIGS. 2A, 2B are side-views of the reel assembly including spring, arbor, and reel assembly of the present invention.
Figure 2B:
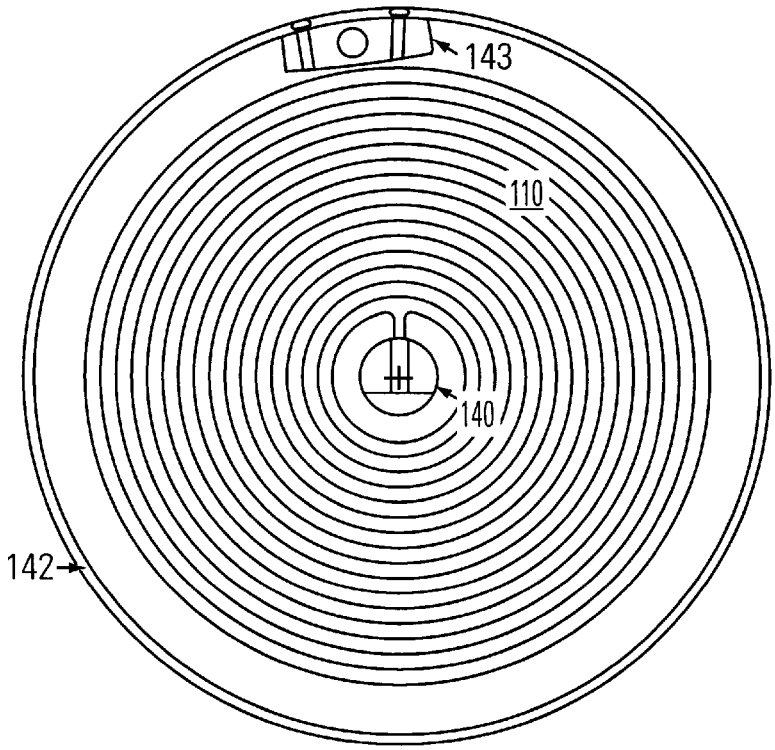
Figure 3A:
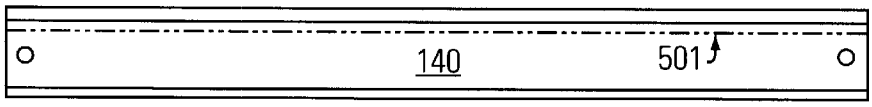
FIG. 3A is a side-view of the arbor of the present invention.
Figure 3B:
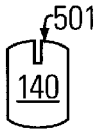
FIG. 3B is a front-view of the arbor of the present invention.
Figure 3C:
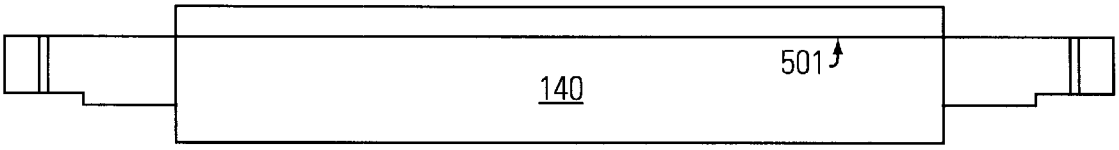
FIG. 3C is a side-view of the arbor of the present invention.
Figure 3D:
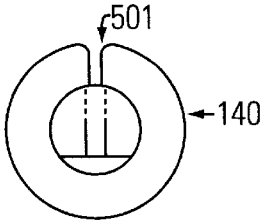
FIG. 3D is a front-view of the arbor of the present invention.

With reference to FIGS. 2A and 2B, a side-view of a single power spring 110 is illustrated. Each power spring 110 is attached to an arbor 140. The other end of each spring 110 is attached to feature 143 on the reel assembly hub 142. Each spring 110 is made of stainless or carbon steel and is designed for a satisfactory fatigue life. Each spring 110 is designed to exert a constant torque; that is, as the springs 110 are compressed or released, the relationship of the pulling force to the amount of compression is linear. Whether the springs 110 are either fully compressed or fully expanded, the amount of pulling force exerted by the springs 110 is constant. Therefore, if the cables 130 are extended by any amount up to their limit, the springs 110 will exert sufficient torque to rewind the present invention cables back onto the reel assembly 100 (FIG. 1A or 1D), returning the dock to its initial position.

With reference still to FIGS. 2A and 2B, the springs 110 are designed to exert a specified amount of torque. The amount of torque provided by the present invention springs 110 is by design sufficient to maintain a floating dock in its initial and stable position. However, the amount of torque provided by the springs 110 is by design small enough to still permit the present invention cables 130 to extend as needed in response to waves, passing boats, the rising tide, and gusts of wind. Nevertheless, the amount of torque provided by the springs 110 is by design sufficient to return the dock to its initial and stable position after the disturbance has ended. In the currently preferred embodiment, between approximately ten and one-hundred thirty pounds of pull-force is implemented per spring 110; however, by design the present invention takes advantage of the synergistic effect associated with having springs mounted side by side on a single arbor, so that the total pull-force of the currently preferred embodiment of the present invention is between forty and one-thousand three hundred pounds.

With reference to FIGS. 3A, 3B, 3C and 3D the arbor 140 is illustrated. A notch 501 is cut through the length of the arbor 140. One end of the spring 110 (FIGS. 2A and 2B) is fixedly attached to arbor 140 via notch 501. The other end of the spring 110 (FIGS. 2A and 2B) is fixedly attached to a feature 143 (FIGS. 2A and 2B) on the reel case hub 142 of the reel assembly 100 (FIGS. 2A and 2B). Referring back to FIGS. 1A, 1B, 1C, 1D, 2A and 2B, the springs 110 are attached between the arbor 140 and feature 143 on the reel case hub 142 of the reel assembly 100. The reel assembly 100 and the springs 110 therefore work in conjunction with each other. Rotation of the reel assembly 100 in one direction or the other will cause the spring 110 to compress or expand accordingly, which transfers the corresponding torque from the springs 110 to the reel assembly 100.

Referring back to FIGS. 1A, 1D, 2A and 2B, the reel assembly 100 is centered on the shaft 140 inside the case 120 or frame 160. The size of the reel assembly 100 is governed by the number of rotations of the reel permitted by the springs 110. In other words, the reel assembly 100 is of the proper size needed to permit the entire length of cables 130 to be dispensed and retracted, without exceeding the design capabilities of the springs 110 to correspondingly compress and expand.

Figure 4A:
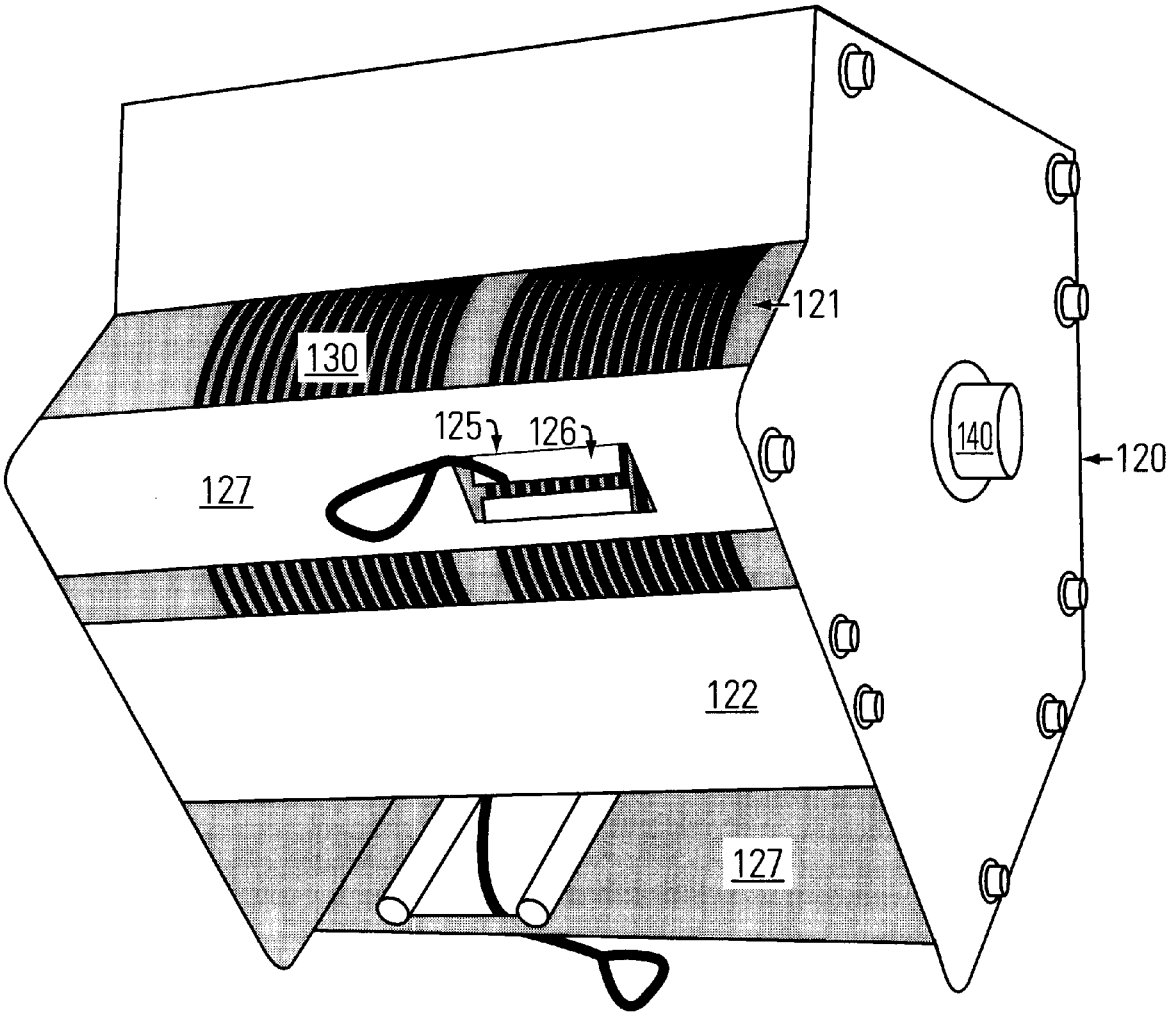
FIG. 4A is a picture of the present invention showing the outer case, arbor, and cables of the present invention.
Figure 4B:
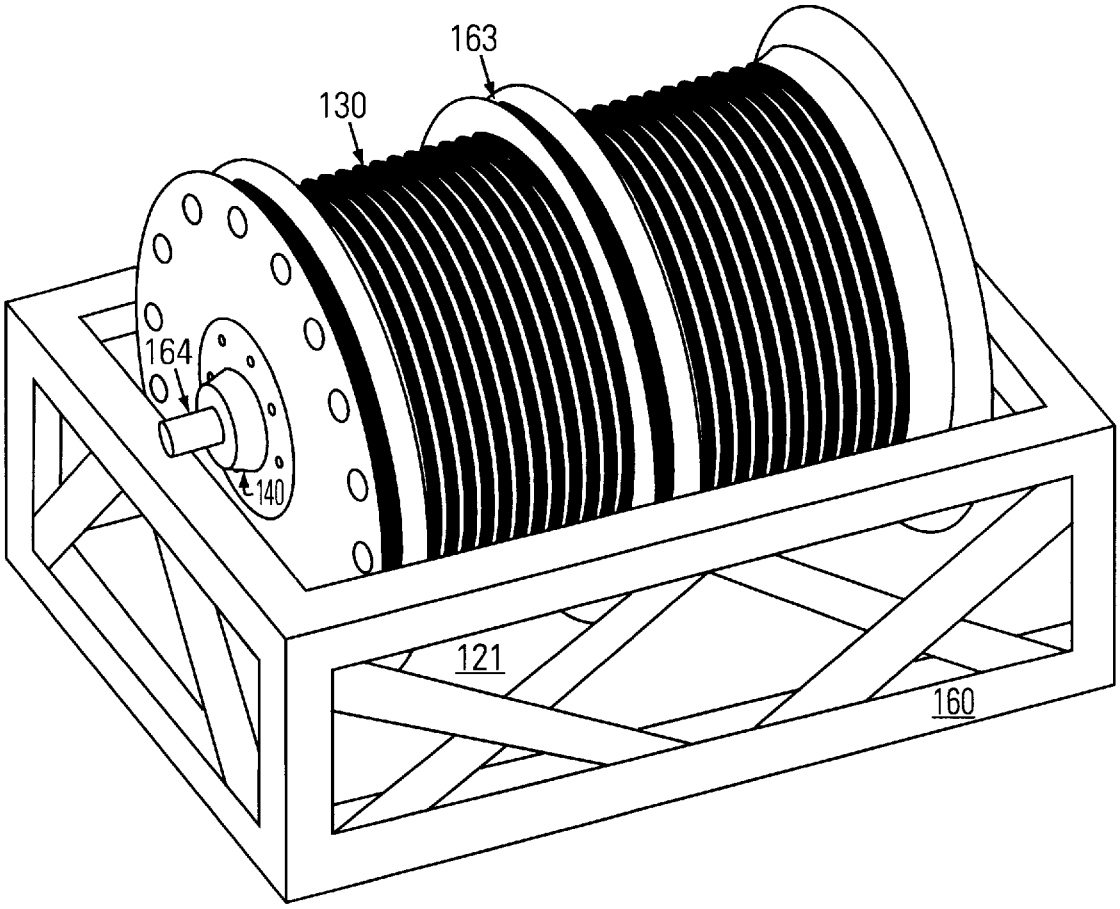
FIG. 4B is a picture of the present invention showing the frame, arbor, and cables of the present invention.

Referring to FIGS. 4A and 4B and also back to FIGS. 1A, 1B, 1C and 1D the reel assembly 100 and springs 110, including the shaft 140, are enclosed within an outer case 120 or frame 160. In the currently preferred embodiment, the outer case 120 and frame 160 is composed of high quality marine materials to provide resistance to corrosion. In the currently preferred embodiment FIG. 4A, the outer case is solid except for opening 121 to allow access to the cables 130 if needed. In the currently preferred embodiment FIG. 4B, the frame 160 is open allowing access to the cables 130 if needed. For structural rigidity in FIG. 4A, the opening 121 is bridged by center bar 122. The outer case 120 also incorporates two additional smaller openings 125. The cables 130 come off the reel at different points, and each passes through its own opening 125. For structural rigidity in FIG. 4B, the frame 160 is designed with a truss configuration. The cables 130 come off the reel at the same point, and each passes through the opening at the bottom of the frame 160.

In FIG. 4A the smaller openings 125 are flared with a roller assembly 126 to reduce friction on the cables as they pass through. The smaller openings are mounted on bars 127. The preferred orientation of the smaller openings 125 is 90 degrees relative to each other. This design feature permits the present invention to be mounted on smaller floating docks, with the cables 130 extending below the dock at a more vertical angle so that they don't extend beyond the edge of the dock.

Figure 5A:
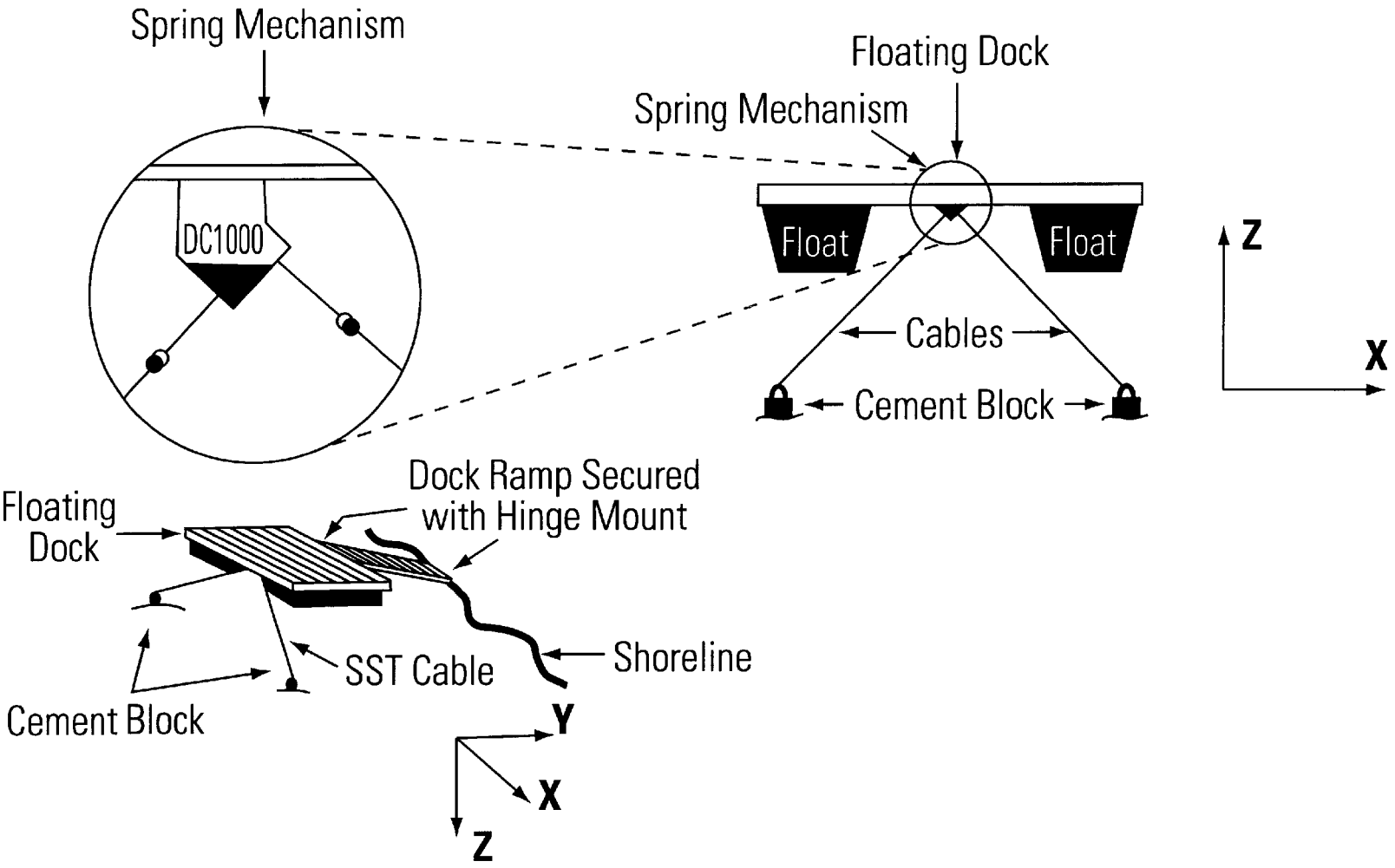
FIGS. 5A, 5B and 5C are illustrations of the application of the present invention as a dock mooring mechanism.
Figure 5B:
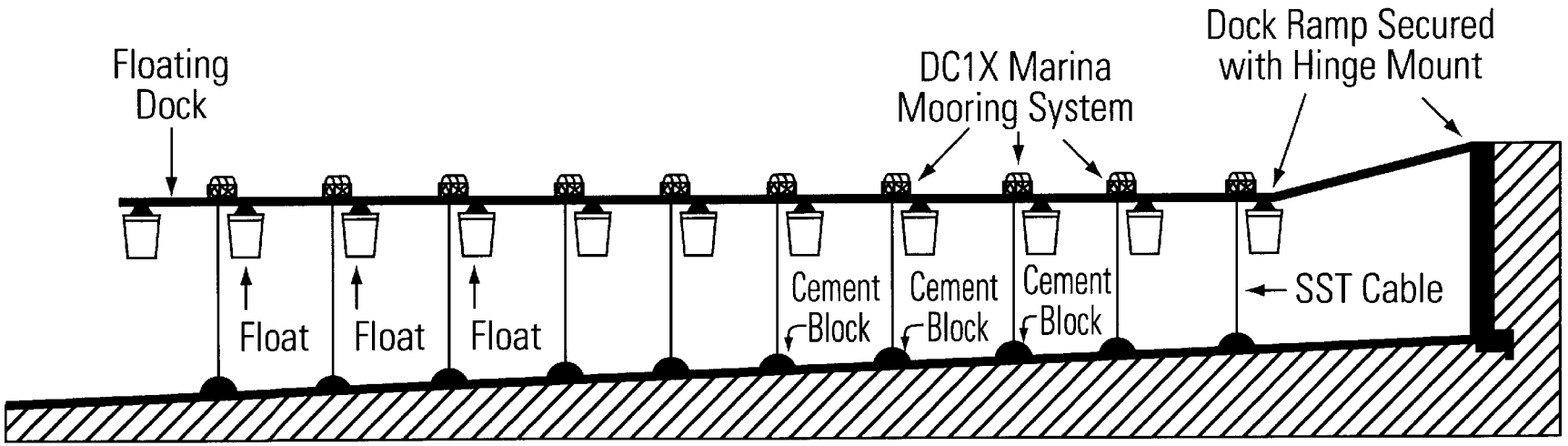
Figure 5C:
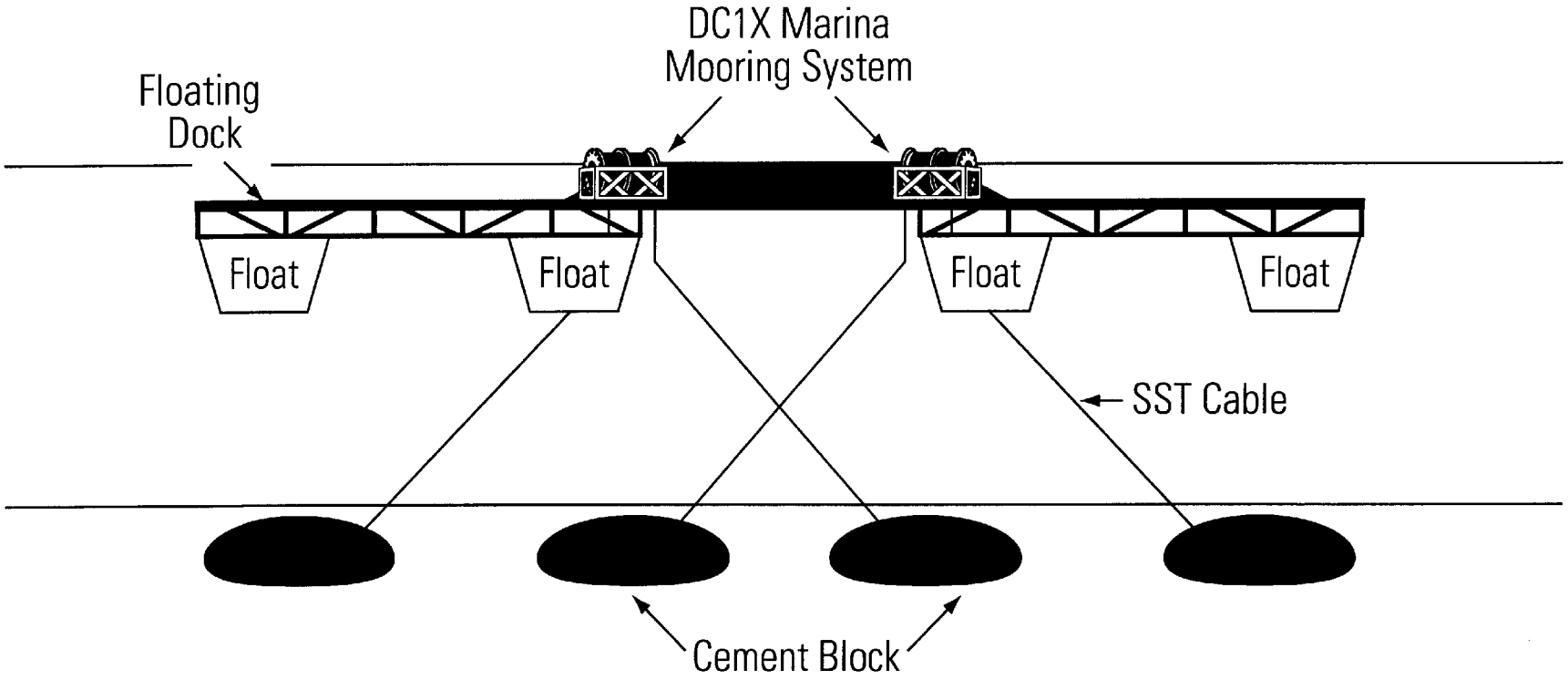

With reference still to FIG. 4, the arbor 140, about which the reel assembly 100 (FIG. 1A) and springs 110 (FIG. 2) are mounted, is passed through each side of the outer case 120 so that it is permitted to rotate freely. In the currently preferred embodiment, the arbor 140 is held in place using cotter pins. With reference to FIG. 5, the application of the present invention to anchor a floating dock is illustrated. The present invention is attached at the center point of the floating dock and attached to weights on the floor of the body of water.

The preferred embodiment of the present invention, a floating dock mooring system, is thus described. While the present invention has been described in particular embodiments, it should be appreciated that the present invention should not be construed as limited by such embodiments, but rather construed according to the following claims.

What is claimed is:

1. An apparatus for use in conjunction with a floating dock to stabilize the dock while allowing for a degree of lateral and vertical movement of the dock, comprising a spring-loaded mechanism comprising a reel around which a first line and a second line are wound, the spring-loaded mechanism attached at one end to the floating dock and at the other end to a first fixed point through the first line and to a second fixed point through the second line extending, respectively, from the first and second fixed points to the spring-loaded mechanism, wherein the spring-loaded mechanism provides a force acting to pull the floating dock towards the first and second fixed points and dispenses and retracts the first line and the second line by approximately the same amount according to any outside forces acting on the floating dock, thereby balancing the forces acting on the floating dock and returning the floating dock to an equilibrium position.

2. The apparatus of claim 1, wherein the spring-loaded mechanism comprises: an outer case; a shaft fixedly attached to the outer case;

a reel assembly rotatable about the shaft; a first spring attached at one end to the shaft and at the other end to the reel, wherein the first spring produces a torque acting on the reel to cause the first line and the second line wound about the reel to retract and pull the dock towards the first fixed point and the second fixed point until an equilibrium is reached and to extend the first line and the second line by approximately the same amount when the equilibrium is exceeded.

3. The apparatus of claim 2 further comprising a second spring parallel to the first spring and attached to the shaft and the reel, wherein the second spring provides additional torque.

4. The apparatus of claim 3 further comprising a third spring parallel to the first spring and the second spring and attached to the shaft and the reel, wherein the third spring provides additional torque.

5. The apparatus of claim 2, wherein the first line and the second line are wound side-by-side about the reel.

6. The apparatus of claim 2, wherein the first spring provides a constant torque.

7. The apparatus of claim 2 further comprising a first flared opening in the outer case through which the first line passes and a second flared opening in the outer case through which the second line passes.

8. The apparatus of claim 1 further comprising a first roller abutting the first line which rolls when the first line is dispensed or retracted and a second roller abutting the second line which rolls when the second line is dispensed or retracted.

* * * * *